US005474254A

United States Patent [19]

Faulkner

[11] Patent Number: 5,474,254

[45] Date of Patent: Dec. 12, 1995

[54] SPOOL AND METHOD OF MAKING SAME

[75] Inventor: Arnold T. Faulkner, Berrien Springs, Mich.

[73] Assignee: Faulkner Fabricators, Inc., Berrien Springs, Mich.

[21] Appl. No.: 335,946

[22] Filed: Nov. 8, 1994

[51] Int. Cl.[6] ..... B65H 75/14

[52] U.S. Cl. ..... 242/614; 242/614.1

[58] Field of Search ..... 242/614, 614.1, 242/610.1, 610.2, 610.3, 610.4, 610.5, 610.6, 608.7, 118.4, 118.41, 118.5, 118.6, 118.61, 118.62, 118.7, 118.8

[56] References Cited

U.S. PATENT DOCUMENTS

| | | | |
|---|---|---|---|
| 1,213,630 | 1/1917 | Halliday . | |
| 1,341,815 | 6/1920 | Mossberg . | |
| 1,391,372 | 9/1921 | Connell | 242/610.3 |
| 1,801,054 | 4/1931 | Mossberg . | |
| 1,811,517 | 6/1931 | Mossberg . | |
| 1,816,651 | 7/1931 | Mossberg . | |
| 1,819,337 | 8/1931 | Pevear . | |
| 2,250,281 | 7/1941 | Sundstrand . | |
| 2,339,245 | 1/1944 | Bates . | |
| 2,411,937 | 12/1946 | Powell . | |
| 3,099,414 | 7/1963 | Kulka | 242/614 |
| 3,108,758 | 10/1963 | Hill | 242/614.1 |
| 3,176,932 | 4/1965 | Kovaleski . | |
| 3,276,716 | 10/1966 | Hofbauer | 242/614 X |
| 3,342,435 | 9/1967 | Gelardi et al. | 242/614 |
| 3,565,363 | 2/1971 | Mizuguchi | 242/118.8 X |
| 3,827,651 | 8/1974 | Benson et al. . | |
| 4,140,289 | 2/1979 | Kovaleski . | |
| 5,106,031 | 4/1992 | Sanda et al. . | |

FOREIGN PATENT DOCUMENTS

| | | | |
|---|---|---|---|
| 310735 | 9/1933 | Italy | 242/118.4 |
| 1006495 | 10/1965 | United Kingdom | 242/614.1 |

*Primary Examiner*—John M. Jillions
*Attorney, Agent, or Firm*—Barnes & Thornburg

[57] ABSTRACT

A spool for winding wire, rope or other materials includes a hub having a flange disposed on each end thereof. The flanges are deflected outwardly from the hub. Each flange contains a plurality of ribs that project from the interior surface of the flange so as to provide a constant width for winding the material on the hub.

11 Claims, 1 Drawing Sheet

SPOOL AND METHOD OF MAKING SAME

BACKGROUND AND SUMMARY OF THE INVENTION

The present invention relates to a spool for winding wire, rope and similar materials.

Various spools for winding wire, rope and similar materials are known in the prior art. Typically, such spools consist of a central hub or barrel secured to a pair of flanges. The flanges extend radially outwardly from the ends of the hub so as to define a space between the flanges in which wire, for example, may be wound about the hub. The wire is typically wound onto the spool by placing the spool in a winding machine and rotating the spool about the longitudinal axis of the hub. The machine may be set to wind the wire over a specified distance, typically the length of the hub, which also corresponds to the distance between the flanges. In this manner, the wire is wound on the hub in layers and is contained between the flanges.

During the winding process, the rotation of the spool and the tension on the wire cause a force to be exerted on the peripheries of the flanges. This force may cause the peripheries to bend away from the hub and inward toward the axis of rotation. As a result, the distance between the flanges is greater at the peripheries than at the hub. As noted above, the winding machine may be set to wind the wire along the length of the hub such that the wire is contained by the flanges. If the distance between the flanges varies, the upper layers of wire may spread out on the hub to fill the space between the flanges. This may result in wire segments from one layer crossing over into another layer. Ultimately, the wire may become tangled or knotted on the spool.

Accordingly, it is an object of the present invention to provide a spool for winding wire, rope or similar materials.

Another object of the present invention is to provide a spool that is durable.

Yet another object of the present invention is to provide a spool that has a winding surface of constant length.

These and other objects of the present invention are attained by the provision of a spool for winding material, comprising a hub having a first end and a second end, a first flange secured to the first end of the hub and a second flange secured to the second end of the hub, each of the flanges angling outwardly from the hub, and a first rib disposed on the first flange and a second rib disposed on the second flange. The ribs define the width of layers of material wound on the hub. The width defined by the ribs may be constant. The width of the ribs may vary along their lengths. Also, the ribs may extend radially outward from the hub and project from a surface of the flange.

According to another embodiment of the present invention, a spool comprises a hub having a first end and a second end, a flange disposed on each end of the hub and angled outwardly therefrom and means for containing layers of material on the hub such that all of the layers are of a constant width. The invention further includes a method for making the various embodiments.

Other objects, advantages and novel features of the present invention will be apparent upon consideration of the following description of the preferred embodiments and accompanying drawings.

DETAILED DESCRIPTION OF THE PREFERRED EMBODIMENTS

Figure 1:
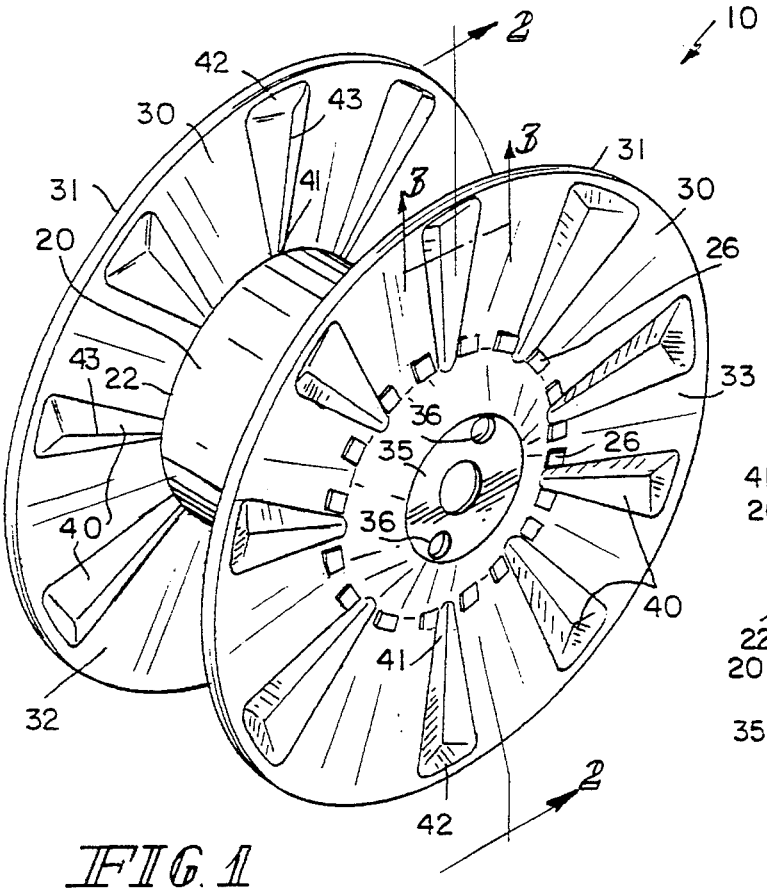
FIG. 1 is a perspective view of a spool according to the present invention.
Figure 3:
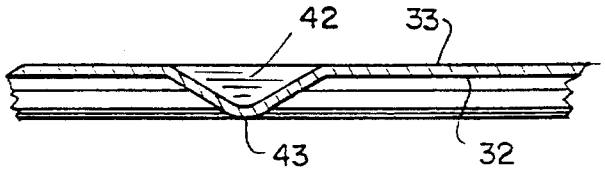
FIG. 3 is a cross-sectional view taken along line 3—3 in FIG. 1.

FIG. 1 shows a perspective view of a spool 10 according to the present invention. Spool 10 generally comprises hub 20, flanges 30 and ribs 40. Hub 20 is a generally cylindrical member having a first end 22 and a second end 24. Hub 20 includes a plurality of tabs 26 formed on first end 22 and second end 24. Tabs 26 are used to assemble spool 10, as described below. Hub 20 may be formed from a metal sheet which is bent to the desired radius. The wire, rope or other material to be contained on spool 10 will be wound about hub 20.

Figure 2:
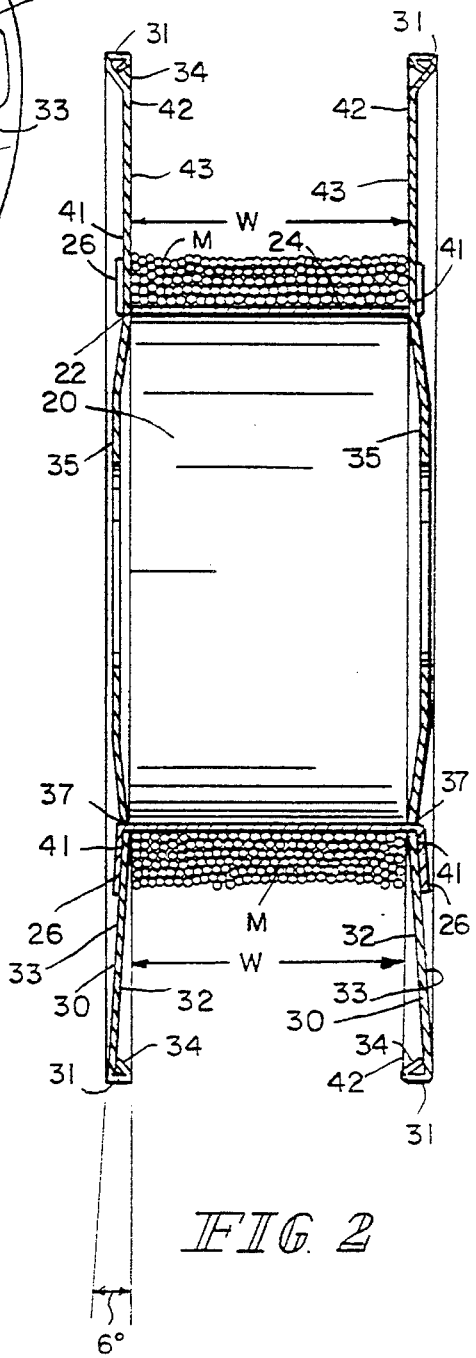
FIG. 2 is a cross-sectional view taken along line 2—2 in FIG. 1, and further including material M wound on the spool.

Each flange 30 is, for example, a generally circular member having an outer edge 31, an inner surface 32 and an outer surface 33. Edge 31 is bent or rolled so as to form a lip 34. A raised mounting area 35 is formed on each flange 30 so as to project outwardly from the remainder of outer surface 33. Mounting area 35 provides a substantially flat surface for mounting spool 10 in a winding machine, as discussed below. Each mounting area 35 also includes a pair of holes 36 therein, which are used to mount and drive spool 10, as described below. Flanges 30 further include a plurality of slots 37 (two of which are shown in FIG. 2) arranged circumferentially about mounting area 35. Slots 37 receive tabs 26 of hub 20 during assembly. Flanges 30 are deflected outwardly such that they are in effect truncated cones. Thus, when flanges 30 are secured to hub 20 (as described below) they angle outwardly from first end 22 and second end 24. In one embodiment, flanges 30 are deflected approximately six degrees from ends 22 and 24 of hub 20.

A plurality of ribs 40 are formed on each flange 30. Ribs 40 include a first end 41 disposed near hub 20 and a second end 42 disposed near outer edge 31 of flange 30. In the embodiment shown, ribs 40 are wider at second end 42 than at first end 41. Each rib 40 further includes a winding surface 43. Winding surface 43 extends from first end 41 to second end 42 of rib 40. As previously noted, flanges 30 are deflected outwardly from hub 20. Winding surface 43 projects from inner surface 32 of flange 30 as it extends toward edge 31. Accordingly, all of the winding surfaces 43 on each flange lie in the same plane along their entire length. In this manner, winding surfaces 43 define a constant width W for the layers of wire or other material M to be wound on hub 20. Ribs 40 may be formed in flanges 30 by stamping.

To construct spool 10, flanges 30 are cut and bent to the desired degree of deflection. Edge 31 of each flange 30 is bent to form lip 34. Mounting area 35 and ribs 40 are stamped and holes 36 and slots 37 are formed. Tabs 26 from first end 22 and second end 24 are then inserted in slots 37 in flanges 30 and bent over to secure flanges 30 to hub 20. A spool 10 according to the present invention could also be formed by die-casting.

In operation, spool 10 is mounted in a winding machine. This is accomplished by placing mounting areas 35 against the winding machine's mounting plates. The plates include pins that project into holes 36 in mounting areas 35. The mounting plates are then rotated, which causes spool 10 to rotate so as to take on wire, rope or other material.

As previously noted, the force generated on the flanges during winding of prior art spools was often sufficient to cause bending of the flanges. The bending would continue until the stresses generated in the flanges were sufficient to resist further bending. In a spool 10 according the present invention, flanges 30 are deflected during manufacture to form truncated cones. Any further deflection will reduce the circumference of each flange 30 a greater amount per unit of deflection and produce greater resistance to deflection. Thus, flanges 30 resist further bending during winding. Because ribs 40 rise to compensate for the deflection of flanges 30, a constant winding width is maintained.

Although the invention has been illustrated and described in detail, it is to be clearly understood that the same is by way of illustration and example only and is not to be taken by way of limitation. Various changes may be made to the disclosed embodiments with out departing from the scope of the invention. For example, ribs 40 may take a shape other than that shown. The number of ribs 40 may also be varied. The degree of deflection of flanges 30 may also be varied. Accordingly, the spirit and scope of the invention are to be limited only by the terms of the appended claims.

What is claimed is:

1. A spool for winding material, comprising:

a hub having a first end and a second end;

a first flange secured to said first end of said hub and a second flange secured to said second end of said hub, each of said flanges angling outwardly from said hub; and a first rib disposed on said first flange and a second rib disposed on said second flange, said first and second ribs defining the width of layers of material wound onto said hub.

2. The spool according to claim 1, wherein the distance defined by said ribs is constant.

3. The spool according to claim 1, wherein the width of said ribs varies along their length.

4. The spool according to claim 1, wherein said ribs extend radially outward from said hub and project from a surface of each of said flanges toward the other flange.

5. A spool, comprising:

a hub having a first end and a second end;

a flange disposed on each end of said hub and angled outwardly therefrom; and means for containing layers of material on said hub such that all of said layers are of a constant width.

6. The spool according to claim 5, wherein said means for containing layers of material on said hub is disposed on at least one of said flanges.

7. The spool according to claim 6, wherein said means for containing layers of material on said hub includes a rib.

8. The spool according to claim 7, wherein said rib includes a first end adjacent said hub, a second end adjacent an edge of said flange and a surface extending from said first end to said second end and projecting from said flange.

9. A method of manufacturing a spool comprising the steps of:

providing a pair of flanges in the form of truncated cones;

attaching said flanges to a hub such that said flanges angle outwardly from said hub; and forming a plurality of ribs on said flanges such that said ribs define a constant width for winding material on said hub.

10. The method according to claim 9 wherein said spool is die-cast.

11. The method according to claim 9 wherein said spool is injection molded.

* * * * *